US006745828B1

(12) United States Patent
Lehman

(10) Patent No.: US 6,745,828 B1
(45) Date of Patent: Jun. 8, 2004

(54) BRAZED-PLATE HEAT EXCHANGER AND AIR DISTILLATION DEVICE FITTED WITH SAID EXCHANGER

(75) Inventor: Jean-Yves Lehman, Maisons-Alfort (FR)

(73) Assignee: L'Air Liquide - Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/914,845

(22) PCT Filed: Mar. 1, 2000

(86) PCT No.: PCT/FR00/00510

§ 371 (c)(1),
(2), (4) Date: Sep. 4, 2001

(87) PCT Pub. No.: WO00/52408

PCT Pub. Date: Sep. 8, 2000

(30) Foreign Application Priority Data

Mar. 1, 1999 (FR) ..... 99 02503

(51) Int. Cl.[7] ..... F28F 3/08
(52) U.S. Cl. ..... 165/166; 62/903
(58) Field of Search ..... 165/166; 62/903

(56) References Cited

U.S. PATENT DOCUMENTS 3,590,909 A 7/1971 Butt
3,792,842 A * 2/1974 Nakako et al. ..... 261/148
3,860,065 A 1/1975 Schauls
3,983,191 A 9/1976 Schauls
3,992,168 A * 11/1976 Toyama et al. ..... 165/166
4,473,110 A 9/1984 Zawierucha
5,035,284 A * 7/1991 Oya et al. ..... 165/166
5,144,809 A * 9/1992 Chevalier et al. ..... 165/166
5,787,975 A * 8/1998 Grenier et al. ..... 165/166
5,901,574 A * 5/1999 Rohde ..... 62/640
6,128,920 A * 10/2000 Matsuo et al. ..... 62/627

FOREIGN PATENT DOCUMENTS

FR 2 085 924 12/1971
FR 2 154 352 5/1973

* cited by examiner

*Primary Examiner*—Allen Flanigan
(74) *Attorney, Agent, or Firm*—Young & Thompson

(57) ABSTRACT

The heat exchanger can be used for the vaporization of a pressurized liquid and comprises at least one passage way (P) for a liquid extending in a first direction, being provided with exchange waves that are substantially parallel to the first direction and comprising at least one redistribution area associated with at least one lateral collector in an intermediate area of the length thereof, in addition to being provided with deviation waves extending in at least one second direction forming an angle with the first direction, whereby the redistribution area takes up the entire width of the passage way, in a crosswise position with respect to the first direction, whereby the deviation waves communicate with the exchange waves. The deviation waves are essentially as rigid as the exchange waves. The invention can be used with exchangers in pumped air-distillation devices.

23 Claims, 1 Drawing Sheet

BRAZED-PLATE HEAT EXCHANGER AND AIR DISTILLATION DEVICE FITTED WITH SAID EXCHANGER

The present invention relates to brazed-plate heat exchangers, of the type comprising at least one fluid passage extending in a first direction, provided with exchange fins substantially parallel to the first direction and comprising, in an intermediate area of its length, at least one redistribution zone associated with at least one lateral collector and provided with deflection fins extending along at least a second direction forming an angle with the first direction, this redistribution zone occupying the entire width of the passage, crosswise to the first direction, the deflection fins all communicating with exchange fins.

The document "The standards of the brazed aluminum plate-fin heat exchanger manufacturer's association", Alpema, first edition 1994, describes various heat-exchanger configurations of this type.

More particularly, although not exclusively, the present invention relates to heat exchangers for vaporizing pressurized liquids, in particular pressurized cryogenic liquids.

Air separation apparatus of the "pump" type produces at least one gas from air (generally oxygen) in liquid form which is pressurized by a pump before its vaporization, thus enabling the compression of the pure products in gaseous form by a compressor to be avoided, which is particularly beneficial, both economically and technically, and safer with oxygen. The pressurized liquid is warmed and vaporized in a heat-exchange line which generally consists of one or more exchanger bodies, typically of the plate type and made of brazed aluminum. At the point in the exchanger where the pressurized liquid stops vaporizing, there are abrupt variations in the exchange coefficient of this fluid resulting from flow fluctuations causing the product to pass from a two-phase mixture state, with a high exchange coefficient, to a purely gaseous state, with a much lower exchange coefficient. This leads to an appreciable local variation in the temperature of the wall or plate and of the exchanger fins. When the temperature difference between the fluid being vaporized and the adjacent heat-transfer fluids is appreciable, possibly greatly exceeding 10° C., and typically between 10° C. and 30° C., the local temperature of the wall and of the fins may vary rapidly and abruptly, typically by 5 to 15° C. in a repetitive manner, which is enough to cause thermal fatigue phenomena.

When these fluctuations occur in a homogeneous zone of the exchanger, the fatigue remains very limited. On the other hand, the fatigue becomes considerable when the fluid stops vaporizing opposite deflection fins contained in the heat-transfer fluid passages. This situation corresponds, for example, to an outlet of partially cooled air intended for expansion in a turbine in order to keep the plant cold. This is because the thermal fatigue phenomena are aggravated by the thermal and mechanical heterogeneities of the structure, the distribution or deflection fins being spaced further apart and thicker, and therefore stiffer, than the exchange fins, in order to provide a lower resistance to the passage of fluids while providing the desired mechanical strength. Generally, the deflection fins have a pitch which is greater than the exchange fins in order to reduce the pressure drop of the distribution zones, and consequently these deflection fins are thicker in order to withstand the pressure. Other unfavorable factors are the presence of dead spots, and possibly of separation bars, in the redistribution zones.

Thus a tendency for the plates to fail in the boundary regions of the deflection fins is observed.

These thermal fatigue phenomena are particularly difficult to prevent in the intermediate redistribution zones where heat-transfer fluid is removed from the container and/or is introduced into it. This is because, depending on the type of market for the plant, the end-of-vaporization point varies considerably in the adjacent passages, and it is not possible to counteract a large height in the heating passages in order to position the redistribution zones.

The object of the present invention is to provide a heat-exchanger structure comprising at least one redistribution zone avoiding, in particular, the drawbacks mentioned above.

To achieve this, the subject of the invention is an exchanger of the aforementioned type, characterized in that the deflection fins have substantially the same stiffness as the exchange fins.

With the arrangement according to the invention, it is thus possible to eliminate the dead spots in the redistribution zone, which prevents having the surface of the exchanger follow only the temperature of the vaporized fluid, and provides good thermal and mechanical homogeneity between the redistribution zone and the exchange zones. The thermal fatigue phenomena are thus considerably reduced.

With such an arrangement, the distribution zone has a stiffness comparable to that of the rest of the passage, and heat exchange with the fluids whose temperature changes the least and the most slowly is enhanced.

According to one characteristic of the invention, the deflection fins have substantially the same geometric proportions as the exchange fins, that is to say they have relatively little stiffness and provide a good heat-exchange surface. In this context, the use of an internal separation or sealing bar usually placed between the upstream and downstream part of a redistribution zone is preferably precluded.

In contrast, according to one aspect of the invention, the deflection fins and the exchange fins may be of different types (perforated and nonperforated, and/or serrated and nonserrated).

The object of the present invention is also to propose the application of such an exchanger to the vaporization of pressurized liquids, typically to the vaporization of pressurized cryogenic liquids.

For this reason, another subject of the invention is an air distillation apparatus producing at least one pressurized cryogenic liquid and equipped with at least one such exchanger serving to vaporize this liquid.

Other features and advantages of the present invention will emerge from the following description of several embodiments, given by way of illustration but in no way limiting, with reference to the appended drawings, in which.

In the following description, and in the drawings, identical or similar elements bear the same, but possibly subscripted, reference numbers. In the drawings, the exact geometric proportions are not respected, in order to facilitate the reading thereof.

Figure 1:
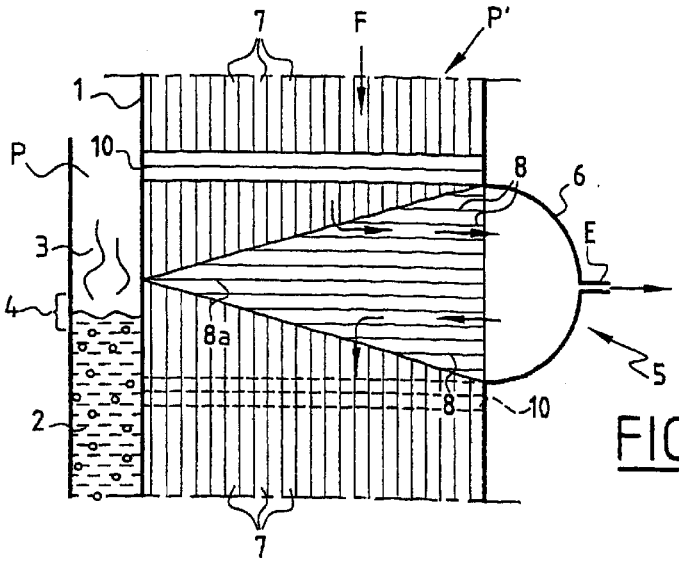
FIG. 1 is a schematic view of one embodiment of a redistribution zone of a heat exchanger according to the invention.

FIG. 1 shows, very schematically, a wall or plate 1 of a plate exchanger made of brazed metal separating two fluid passages, one P of which, as drawn in cross section in the left part of FIG. 1, conveys a fluid which transforms by vaporization from a liquid state 2 to a gaseous state 3. At the interface zone 4 where the pressurized liquid phase stops vaporizing, a redistribution zone 5 is shown in an adjacent passage P' shown in longitudinal section, from which the heat-transfer fluid, flowing normally along the wall 1 in the main flow direction of the heat exchanger (vertically downward in the figure) is deflected laterally toward a collector 6 in order to be partially extracted from the exchanger (arrow E).

Conventionally, the wall 1 is fitted with relatively thin parallel exchange walls 7 of tight pitch (much tighter than shown in the figures so as not to overburden them). According to the invention, in the embodiment of FIG. 1, the stream is deflected from and to the lateral collector 6 by deflection fins 8 of the zone 5, having substantially the same geometric characteristics (thickness, shape, density) as the exchange fins 7, but here extending orthogonally thereto. As can be seen in FIG. 1, the fins 8 are distributed over a prismatic volume with a V-shaped section extending progressively over the entire transverse section of the passage defined by the exchange fins 7, a mid fin 8*a* thus separating the passage into two zones, the one upper zone where the whole of the stream F of heat-transfer fluid descending along the fins 7 is deflected toward the collector 6, and the other lower zone where part of the heat-transfer fluid collected in the collector 6 is redistributed toward the bottom of the passage P' with exchange fins 7.

According to the invention, such an arrangement makes it possible to eliminate the internal sealing bars which constitute mechanical inhomogeneities and which create dead spots, isolated from the passage of fluids and as a result sensitive only to the temperature variations on the other side of the wall.

Advantageously, in order to improve the distribution of the stream in the deflection fins 8, a resistance to flow or pressure drop, typically consisting of a short section of exchange fins 10 arranged in the "hard way", that is to say orthogonally to the stream F and with baffle-type or serrated-type offset openings, is placed upstream and/or downstream of the deflection fins, as shown.

Figure 2:
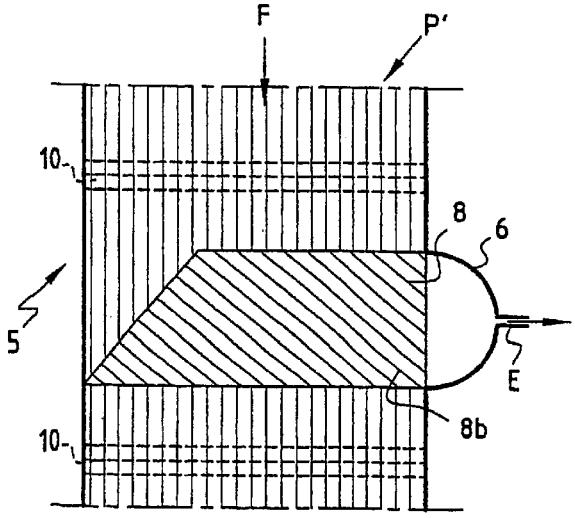
FIG. 2 is a schematic view of a redistribution zone of another embodiment of a heat exchanger according to the invention.

FIG. 2 shows an embodiment where the deflected flow E is preselected by deflecting a predetermined part of the incoming stream F, part of which passes, with redistribution, directly through the redistribution zone 5.

Here, the deflection fins 8 make, with the exchange fins 7, an angle greater than that of the diagonal of the distribution surface, the head of which is defined by the collector 6. One (8*b*) of these fins, which is connected to an exchange fin 7, defines the separation between the stream deflected in the collector 6 and the stream passing directly through the redistribution zone 5. The latter therefore has a right trapezoidal section, with its apex located on the edge of the passage opposite the collector 6 and its upwardly directed oblique side.

Figure 3:
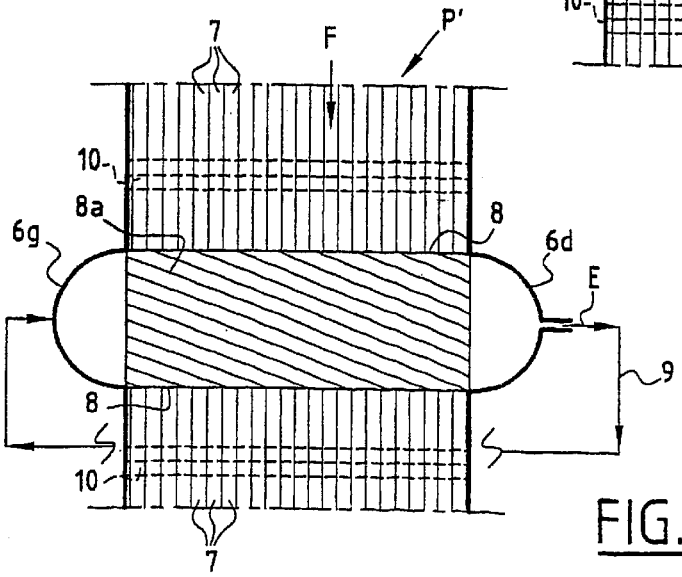
FIG. 3 is a schematic view of yet another embodiment of a redistribution zone of a heat exchanger according to the invention.

FIG. 3 shows an embodiment similar to that of FIG. 2, but this time with deflection fins 8 parallel to the diagonal of the distribution surface, which here is marked by a mid deflection fin 8*a* extending transversely from edge to edge of the main passage. Thus, the zone 5 has a rectangular section and, in a manner similar to the embodiment of FIG. 1, all the incoming stream F is deflected toward the right collector 6*d*, an external line 9 sending part of the stream extracted from the right collector 6*d* back toward a left collector 6*g* feeding half of the fin pattern 8 which communicates with the exchange fins 7 located below the redistribution zone 5. It will be noted, here again, according to one aspect of the invention, that the redistribution zone 5 is completely free of any internal sealing bar, a slight unwanted internal leak between the regions located on either side of the diagonal fin 8*a* not causing any problems.

In each embodiment, the redistribution zone 5 opens out laterally over the entire height of the or each associated collector.

In all cases, according to one aspect of the invention, the deflection fins 8, whether or not of the same type as the exchange fins, are morphologically similar to the latter, with equal or similar pitches (to ±10%, ±20% or ±30%) and also of equal or similar thicknesses (to ±10%, ±20% or ±30%), typically between 0.15 and 0.5 mm, and made of aluminum. Preferably, the same applies to the fins 10 for creating pressure loss, which may also be provided in the case of FIGS. 2 and 3, as indicated by broken lines.

As mentioned above, such exchanger-distributor architectures, typically produced by the assembly of brazed subassemblies and made of aluminum or, at least partly, of stainless steel, have a preferred application in cryogenic air-distillation apparatus producing, in particular, liquid oxygen pressurized by a pump before its vaporization, under pressure in said exchangers, by heat exchange in particular with pressurized air.

What is claimed is:

1. A brazed-plate heat exchanger, of the type comprising at least one fluid passage (P') extending in a first direction, provided with exchange fins (7) substantially parallel to the first direction and comprising, in an intermediate area of its length, at least one redistribution zone (5) associated with at least one lateral collector (6) and provided with deflection fins (8) extending along at least a second direction forming an angle with the first direction, this redistribution zone occupying the entire width of the passage, crosswise to the first direction, the deflection fins (8) all communicating with exchange fins (7), wherein the deflection fins (8) have substantially the same stiffness as the exchange fins (7) and the exchange fins (7) are associated with a structure (10) generating pressure loss located upstream and/or downstream of the redistribution zone (5).

2. The exchanger as claimed in claim 1, characterized in that the deflection fins (8) are morphologically similar to the exchange fins (7).

3. The exchanger as claimed in claim 2, characterized in that the thicknesses of the deflection fins (8) and of the exchange fins (7) are equal.

4. The exchanger as claimed in claim 2, characterized in that the thicknesses of the deflection fins (8) and of the exchange fins (7) differ from each other by at the most 30%.

5. The exchanger as claimed in claim 2, characterized in that the thicknesses of the deflection fins (8) and of the exchange fins (7) differ from each other by at the most 20%.

6. The exchanger as claimed in claim 2, characterized in that the thicknesses of the deflection fins (8) and of the exchange fins (7) differ from each other by at the most 10%.

7. The exchanger as claimed in claim 2, characterized in that the pitches of the deflection fins (8) and of the exchange fins (7) are equal.

8. The exchanger as claimed in claim 2, characterized in that the pitches of the deflection fins (8) and of the exchange fins (7) differ from each other by at the most 30%.

9. The exchanger as claimed in claim 2, characterized in that the pitches of the deflection fins (8) and of the exchange fins (7) differ from each other by at the most 20%.

10. The exchanger as claimed in claim 2, characterized in that the pitches of the deflection fins (8) and of the exchange fins (7) differ from each other by at the most 10%.

11. The exchanger as claimed in claim 1, characterized in that the deflection fins (8) have substantially the same geometric characteristics as the exchange fins (7).

12. The exchanger as claimed in claim 1, characterized in that the deflection fins (8) are of the same type as the exchange fins (7).

13. The exchanger as claimed in claim 1, characterized in that the redistribution zone (5) is free of any internal sealing bar.

14. The exchanger as claimed in claim 1, characterized in that the deflection fins (8) are orthogonal to the first direction.

15. The exchanger as claimed in claim 1, characterized in that one deflection fin **(8*a*)** extends from one lateral edge to the other lateral edge of the distribution zone.

16. The exchanger as claimed in claim 1, characterized in that the redistribution zone (5) has a V-shaped section extending progressively over the entire transverse section of the passage.

17. The exchanger as claimed in claim 1, characterized in that the structure (10) generating pressure loss consists of fins of the hard-way type having a stiffness comparable to that of the exchange fins (7).

18. The exchanger as claimed in claim 17, characterized in that the fins (10) of the hard-way type are morphologically similar to the exchange fins (7) with similar pitches to ±30% and similar thicknesses to ±30%.

19. The exchanger as claimed in claim 18, characterized in that the fins (10) of the hard-way type are of the same type as the exchange fins (7).

20. The exchanger as claimed in claim 1, characterized in that said passage (P') is a heat-transfer fluid passage adjacent to a liquid vaporization passage (P').

21. The exchanger as claimed in claim 1, characterized in that it consists of an assembly of brazed subassemblies.

22. The application of a heat exchanger as claimed in claim 1 to the vaporization of pressurized cryogenic liquid.

23. Air distillation apparatus producing at least one pressurized cryogenic liquid and equipped with at least one heat exchanger according to claim 1 serving to vaporize this liquid.

* * * * *